United States Patent [19]

Fish

[11] Patent Number: 4,602,536

[45] Date of Patent: Jul. 29, 1986

[54] HAND TOOL FOR OPENING SPLIT RINGS

[76] Inventor: Gerald N. Fish, 104 Surf Dr., Cocoa Beach, Fla. 32920

[21] Appl. No.: 181,091

[22] Filed: Aug. 25, 1980

[51] Int. Cl.[4] ..... B25B 7/02

[52] U.S. Cl. ..... 81/418; 29/239

[58] Field of Search ..... 81/418, 420, 421; 29/239, 268, 278

[56] References Cited

U.S. PATENT DOCUMENTS

| | | | |
|---|---|---|---|
| 1,176,793 | 3/1916 | Tuttle . | |
| 1,519,550 | 12/1924 | Pozgay . | |
| 1,862,326 | 6/1932 | Altice . | |
| 1,953,930 | 4/1934 | Dyal . | |
| 2,220,317 | 11/1940 | Cynoske | 81/5.1 R |
| 3,041,729 | 7/1962 | Tofflemire | 81/5.1 R X |
| 3,055,244 | 9/1962 | Snook . | |
| 3,487,524 | 1/1970 | Filia | 81/421 X |
| 3,736,644 | 6/1973 | Simon | 81/5.1 R X |

*Primary Examiner*—James G. Smith

*Attorney, Agent, or Firm*—Roger L. Martin

[57] ABSTRACT

A split ring opening hand tool is shown in the form of a modified pair of long nosed pliers. One jaw carries a support for a split ring while the other jaws carries a probe that passes between the convolutions of the split ring as the jaws are moved to their closed positions. The probe has a laterally facing inclined surface that converges on the tip end of the probe and the support has a groove which provides a laterally facing inclined surface that is encountered by the probe tip end after it passes through the convolutions. This causes relative lateral movement of the jaws as the convolutions are being spread apart by the relative movement of the probe support.

3 Claims, 10 Drawing Figures

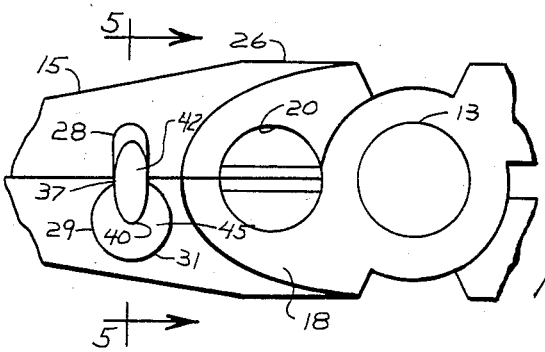
Fig. 4
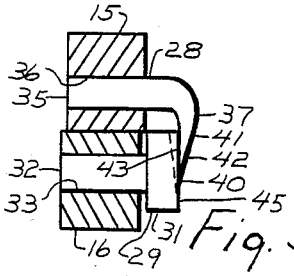
Fig. 5
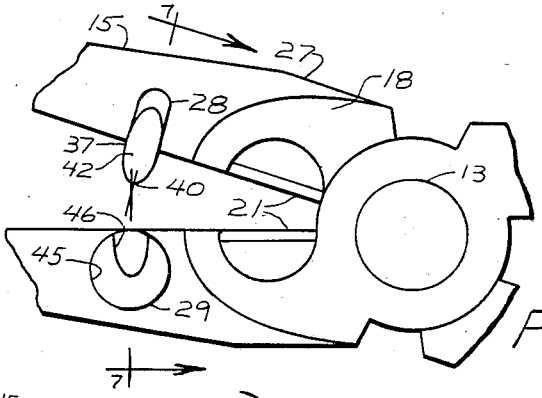
Fig. 6
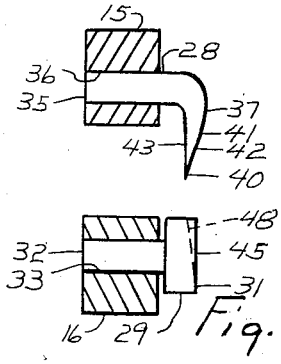
Fig. 7
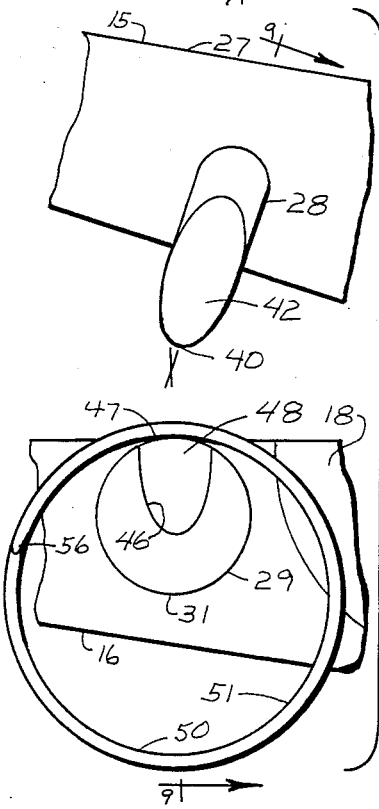
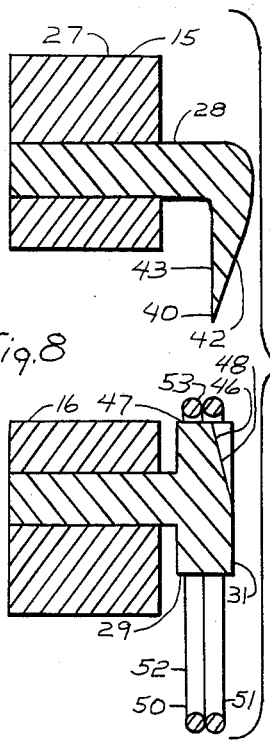
Fig. 8
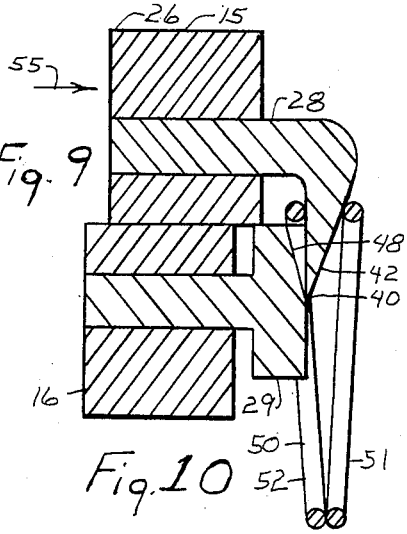
Fig. 9
Fig. 10

HAND TOOL FOR OPENING SPLIT RINGS

BACKGROUND OF THE INVENTION

The invention relates to hand tools and more particularly to hand tools that may be used for opening split rings.

Split rings are used for retaining keys together and they are also used for connecting various and sundry parts together in many different applications. The use of split rings for interconnecting fishing tackle parts such as leaders and spoons is illustrative of but one of the many use applications for such annular elements.

The conventional split ring is formed from an elongated metal element which is wound to provide two contiguous turns or convolutions that touch one another along confronting sides. This arrangements makes it necessary to spread the convolutions apart in order to open the ring for reception of a key or other object that is to be attached thereto. The object, is of course, equipped with an eye or opening through which one of the convolutions is threaded in attaching the object to the ring. When the convolutions are spread apart to receive an object, the metal of the ring is stressed and unless the elastic limit of the metal is exceeded when thus spread apart, the metal recovers its original shape so that the convolutions again become contiguous after the object is attached to the ring and the convolution spreading forces are removed. This metal recovery precludes the removal of the object from the ring until such time as the convolutions are again spread apart for such purposes.

Split rings of the size normally used for attaching keys together are relatively easy to manipulate with the fingers and the convolutions are rarely spread sufficiently far enough apart by a person to exceed the elastic limit and cause permanent deformation of the split ring. On the other hand, split rings which are smaller in size and of the size commonly used in attaching fishing tackle parts are more difficult to open with the fingers and the metal is more frequently stressed beyond its elastic limit as the object or tackle part is attached to the ring. This, of course, makes the split ring unsuitable for its intended purpose and requires a replacement.

In the tackle industry, as well as in other industries, the need arises for attaching various different objects to small split rings that may vary in size from one object to the next and this type work is done by hand. As such, the work is tedious and it would be beneficial to have a tool which would aid the worker in accomplishing the task as well as diminish the number of split rings that are destroyed by exceeding the elastic limit of the metal during the attachment procedures.

SUMMARY OF THE INVENTION

The inventor provides a hand tool that has a pair of jaws which are manipulatable between open and closed positions. One of the jaws is equipped with a support that will accommodate and support a split ring that is to be opened by the tool and the other jaw is equipped with a probe that is adapted and arranged as the jaws are closed to pass between the contiguous convolutions of the split ring. In accord with certain aspects of the invention, the support is provided with a laterally facing groove which provides an inclined surface that is followed by the tip end of the probe after it passes between the convolutions of the split ring. This causes the jaws to move relatively laterally of each other as they assume the closed positions. In accord with other aspects of the invention, the probe itself has a laterally facing and inclined surface that converges upon the tip end of the probe. The inside surface of the probe adjacent to the tip end however is generally parallel to the path of movement of the jaws so that the inclined surface on the probe serves to deflect the outer convolution laterally of the tool while the inside surface retains the inside convolution on the support.

A general object of the invention is to provide a hand tool for use in opening split rings. Yet another object is to provide a tool of the kind contemplated and which minimizes the inadvertent overstressing of the metal of the split ring with the resultant destruction of the split ring. Another object is to provide a tool that makes it easier and quicker for workers to open split rings in preparation for attaching an object thereto. Still another object is to provide a tool of the kind contemplated and which is adapted for use with different size split rings.

BRIEF DESCRIPTION OF THE DRAWINGS

The novel features which are believed to be characteristic of this invention are set forth with particularity in the appended claims. The invention, itself, however, both as to its organization and method of operation, together with further objects and advantages thereof, may best be understood by reference to the following descriptions taken in connection with the accompanying drawings, wherein:

FIG. 4 is an enlarged side elevational view of a fragment of the tool seen in FIG. 1 and as seen in its closed position;

FIG. 5 is a cross sectional view taken generally along the Lines 2—2 of FIG. 4;

FIG. 6 is an enlarged side elevational view of the tool fragment seen in FIG. 1 but as seen with the jaws in their open positions;

FIG. 7 is a cross section taken generally along the Lines 7—7 of FIG. 6;

FIG. 8 is yet a larger side elevational view of a fragment of the tool and as seen with a split ring suspended from the support thereof;

FIG. 9 is a sectional view taken generally along the Lines 9—9 of FIG. 8; and FIG. 10 is a sectional view similar to that of FIG. 9 but with the jaws in the closed positions.

DESCRIPTION OF THE EMBODIMENT

Figure 1:
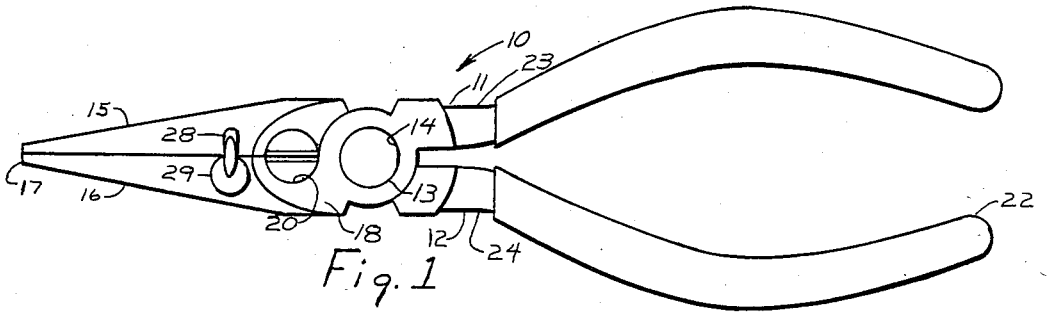
FIG. 1 is a side elevational view of a hand tool embodying the principles of the invention.
Figure 2:
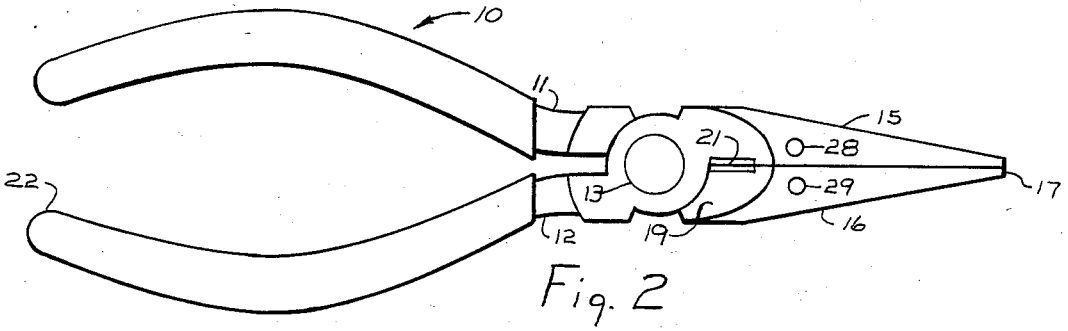
FIG. 2 is an elevational view of the tool shown in FIG. 1 and as seen at the opposite side thereof.
Figure 3:
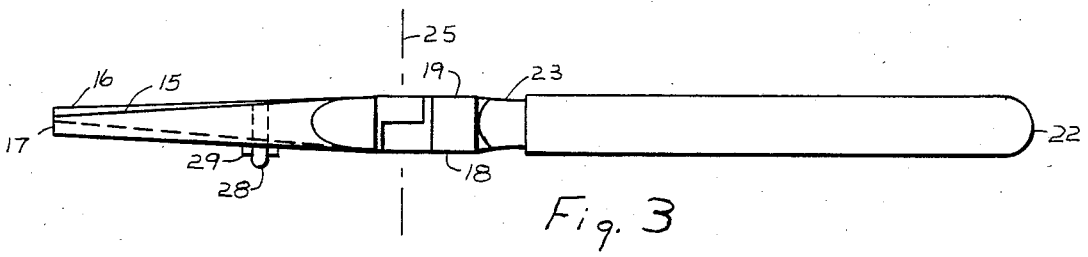
FIG. 3 is a top view of the tool seen in FIG. 1.

Reference is now made to the drawings and wherein a hand tool embodying the principles of the invention is designated at 10. The tool 10 is shown in the form of a modified pair of conventional long nose pliers.

The hand tool 10 includes a pair of elongated forged elements 11 and 12 that are pivotally interconnected between their opposite ends by a pin 13 that is fixed to the element 12 and extends through a suitable opening 14 in element 11. Pin 13, of course, establishes an axis 25 for relative pivotal movement of the elements 11 and 12. The arrangement provides a pair of jaws 15 and 16 that taper toward the working end 17 of the tool 10. Adjacent the pin 13, the jaws are provided at one side 18 of the tool with a cylindrical recess 20 while at the other side 19 of the tool 10 the jaws are provided with a pair of sharp edges 21 that may be used for cutting wire and the like in a manner well known. At the other end 22 of the tool 10, the arrangement provides a pair of lever forming handles 23 and 24 which are fixed to the jaws 15 and 16 and which may be manipulated to pivotally move the jaws between their closed positions 26 (see FIG. 4) and open positions 27 (see FIG. 6).

The upper jaw 15 of the tool 10, as seen in the drawings, is equipped with an elongated element 28 that serves as the probe in opening the split rings on the tool. The lower jaw 16, on the other hand, is equipped with an elongated element 29 that serves as the support for such split rings.

The split ring support has a cylindrical head portion 31 that is located at one side 18 of the tool. The support will accommodate a split ring that can vary in diameter from slightly larger than the diameter of the support head to several times the diameter thereof. It also has an elongated cylindrical shank 32 that extends through and is fixed in a transversely extending bore 33 in the upper jaw 15. The probe 28 has an elongated cylindrical shank 35 that extends through and is fixed in the transversely extending bore 36 in jaw 16. At the side 18 of the tool 10, the probe element 28 is bent to provide a depending portion 37 that is arranged in working alignment with the head 31 of the support element 29.

The tip end 40 of the depending portion 37 of probe 28 is adapted to pass between the convolutions of the split rings. At its outside 41, the depending portion has a laterally facing outwardly inclined planar surface 42 that converges downwardly upon the tip end 40 of the probe 28. The inside 43 of the depending portion 37, on the other hand, is offset and generally parallel to the adjacent side of the tool 10 and to the general path traversed by the jaws 15 and 16 during pivotal movement. This arrangement, as will be subsequently seen, avoids the inward displacement of the inside turn or convolution of the ring while nevertheless forcing the outside turn or convolution of the ring laterally of the tool as the tip end 40 passes between the turns of the split ring.

The head 31 of the split ring support 29 is cylindrical in the illustrations and it is adapted and arranged to fit in the opening of any split ring that is suspended therefrom. The outside face 45 of the head has a generally vertically extending groove 46 which opens through the arcuate split ring support surface 47 at the probe side of the support head. This groove 46 provides a generally laterally facing surface 48 in the opening of any split ring that is suspended on the support head 31 and the surface 48 is inwardly inclined to the path of movement of the jaws and to the general plane of the split ring itself.

The tip end 40 of the probe 28 is arranged in working alignment with the base of the groove at the inner section of the inclined surface 48 and the support surface 47. When the jaws are pivotally moved from their open positions 27 to their closed positions 26, the tip end 40 encounters and follows the inclined surface 48. This tends to force the jaws in opposite lateral directions as the iaws reach their closed position 26. This arrangement has certain advantages. For one, the inclined surface 48 serves to maintain a sharp tip end 40 on the probe 28. The tip end 40 occasionally encounters a turn or convolution on dead center as it moves toward the closed jaw position. This has a tendency to blunt the tip end 40 but such bluntness is remedied as the tip end passes over the inclined surface 48. The lateral movement as the jaws reach their closed position also causes wear on the pivot pin 14 and the parts adjacent thereto. After a short period of use of the hand tool 10, this wear permits a small amount of relatively lateral movement of the probe 28 and support elements 28 and 29 as the elements are approaching one another. This permits the probe 28 to move laterally as it encounters the split ring and thus arrange itself to accommodate differing split rings and turns of different diameters.

The operational of the hand tool 10 in opening a split ring is best illustrated in FIGS. 8–10 and where a split ring 50 with a pair of convolutions 51 and 52 is seen in FIGS. 8 and 9 as suspended on the support head 31. As thus suspended, the general plane of the split ring 50 is generally parallel to the opposite sides 18 and 19 of the tool 10 and the laterally facing surface 48 of head 31 is inwardly inclined to the tool and also inclined to the plane of the ring 50. As the handles 23 and 24 of the tool 10 are manipulated to pivotally move the jaws from the open position 27 (see FIGS. 8–9) to their closed position 26 (see FIG. 10), the tip end 40 of the probe 28 passes downwardly into contact with the ring 50. The initial contact with the ring 50 is normally above the support surface 47 and in the recessed area 53 between the contiguous convolutions or turns 51 and 52. This initial contact causes the ring 50 to orient itself on the support surface 47 so that the contiguous and confronting surfaces of the convolutions which are located above the support surface 49 are above the base of the slot or groove 46. As such, further downward movement of the tip end 40 causes the tip end 40 to pass between the convolutions and thereafter encounter and follow the inclined surface 48 downwardly on the head. As this transpires, jaw 15 moves relatively laterally to jaw 16 as in the direction of arrow 55 and the outer convolution 51 is forced laterally of the inner convolution 52 as it rides up the outwardly inclined surface 42 of probe 28 as seen in FIG. 10. The inside convolution 52 shifts laterally on the support under the influence of the lateral movement of the probe 28 as the jaws enter the closed position seen in FIG. 10. When the convolutions are spread apart, it is relatively simple for the worker to pass the end 56 of the outer convolution through the eye of the object to be attached thereto and to thereafter fully thread the convolution through the eye of the object to complete the attachment.

The size of the probe and more particularly the distance between the inside surface and the outwardly facing inclined surface at the base of the slot when the jaws are in the closed position determines the distance that the turns are spread apart when the outer convolution is threaded into the eye of the object and, of course, is always less than that distance which would cause permanent deformation of the metal and damage to the split ring.

The embodiment of the invention in a pair of long nosed pliers is preferred because the jaws may be manipulated to aid in threading a convolution on an object once it has been initially passed through the eye and occasions also arise where there is a need to cut a damaged split ring from one of the objects. However the principles of the invention may be embodied in a hand tool whose sole function is to spread the convolutions of split rings apart.

While only a certain preferred embodiment of this invention has been shown and described by way of illustration, many modifications will occur to those skilled in the art and it is, therefore, desired that it be understood that it is intended herein to cover all such modifications that fall within the true spirit and scope of this invention.

What is claimed as new and what it is desired to secure by Letters Patent of the United States is:

1. A hand tool for use in spreading the convolutions of a split ring apart, said tool comprising a pair of jaws which are pivotally movable between open and closed positions therefor, one of said jaws having a split ring support which is adapted and arranged to occupy a position in the opening of a split ring supported thereon, the other of said jaws having a probe with a tip end that is adapted and arranged as the jaws are pivotally moved from the open to the closed positions therefor to pass between the convolutions of a split ring supported on the support, said support having a laterally facing surface that is located in the opening of a split ring supported on the support and inclined to the general plane of a split ring supported thereon, and said tip end being arranged during the pivotal movement of the jaws to their closed positions to encounter and follow the inclined surface of the support after it passes between the convolutions of a split ring supported thereon.

2. A hand tool in accord with claim 1 wherein said probe has a laterally facing inclined surface that converges upon the tip end thereof, and wherein the inclined surface of the probe is adapted and arranged to encounter and force one of the convolutions of a split ring supported on the support laterally of the jaws as the tip end of the probe passes between the convolutions during movement of the jaws to their closed positions.

3. A hand tool for use in spreading the convolutions of a split ring apart, said tool comprising a pair of jaws which are pivotally movable between open and closed positions therefore and have opposite sides, a support for a split ring that is mounted on one of said jaws at one of said opposite sides, said support being adapted and arranged to occupy a position in the opening of a split ring supported thereby, a probe that is mounted on the other of said jaws and at said one of said opposite sides, said probe having a tip end that is adapted and arranged as the jaws are pivotally moved from the open to the closed positions therefor to pass between the convolutions of a split ring supported on the support, said support having a laterally facing surface that is located in the opening of a split ring supported on the support and inclined to the general plane of a split ring supported thereon, said tip end being arranged during pivotal movement of the jaws to their closed positions to encounter and follow the inclined surface of the support after it passes between the convolutions of a split ring supported thereon, said probe having a laterally facing inclined surface that converges upon the tip end thereof, and said inclined surface of the probe being adapted and arranged to encounter and force one of the convolutions of a split ring supported on the support laterally of the jaws as the tip end of the probe passes between the convolutions during movement of the jaws to their closed positions.

* * * * *